US008207933B2

(12) United States Patent
Shin et al.

(10) Patent No.: US 8,207,933 B2
(45) Date of Patent: Jun. 26, 2012

(54) BACKLIGHT UNIT, LIQUID CRYSTAL DISPLAY DEVICE INCLUDING THE SAME, AND METHOD OF DRIVING LIQUID CRYSTAL DISPLAY DEVICE

(75) Inventors: Ho-Sik Shin, Bucheon-si (KR); Gi-Cherl Kim, Yongin-si (KR); Sang-Il Park, Seoul (KR); Yong-Hoon Kwon, Asan-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 943 days.

(21) Appl. No.: 12/198,583

(22) Filed: Aug. 26, 2008

(65) Prior Publication Data

US 2009/0073109 A1 Mar. 19, 2009

(30) Foreign Application Priority Data

Sep. 14, 2007 (KR) ..... 10-2007-0093452

(51) Int. Cl.
*G09G 3/36* (2006.01)

(52) U.S. Cl. ..... 345/102; 315/169.3

(58) Field of Classification Search ..... 345/102; 315/169.3

See application file for complete search history.

(56) References Cited

U.S. PATENT DOCUMENTS

| | | | | |
|---|---|---|---|---|
| 2005/0151889 | A1 | 7/2005 | Moon | |
| 2005/0231459 | A1 | 10/2005 | Furukawa | |
| 2007/0171159 | A1* | 7/2007 | Lee | 345/83 |
| 2008/0106205 | A1* | 5/2008 | Wada et al. | 315/89 |

FOREIGN PATENT DOCUMENTS

| | | |
|---|---|---|
| JP | 2005-310998 | 11/2005 |
| KR | 1020050068222 | 7/2005 |
| KR | 1020060045573 | 5/2006 |
| KR | 1020070010613 | 1/2007 |

* cited by examiner

*Primary Examiner* — Yong H Sim
*Assistant Examiner* — Aaron Midkiff
(74) *Attorney, Agent, or Firm* — F. Chau & Associates, LLC

(57) ABSTRACT

A backlight unit includes a substrate and has a plurality of light emitting areas. In each light emitting area, at least one light emitting diode and a bypass current path are connected in parallel between a connection node and a switching unit. The switching unit is configured to connect a selected one of the light emitting diode and the bypass unit to the connection node of the next light emitting area.

21 Claims, 9 Drawing Sheets

BACKLIGHT UNIT, LIQUID CRYSTAL DISPLAY DEVICE INCLUDING THE SAME, AND METHOD OF DRIVING LIQUID CRYSTAL DISPLAY DEVICE

RELATED APPLICATION

This application claims priority, under 35 USC §119, of Korean Patent Application No. 10-2007-0093452 filed on Sep. 14, 2007, which is incorporated herein by reference in its entirety.

BACKGROUND OF THE INVENTION

1. Field of the Invention

The present invention relates to backlights for display panels, and more particularly to a backlight unit capable of reducing the number of backlight unit drivers in a liquid crystal display ("LCD") device including the same, and a method of driving the LCD device.

2. Description of the Related Art

A liquid crystal display (LCD) typically includes an LCD panel, and a backlight unit to supply light to the LCD panel. The LCD panel displays an image by modulating the transmittance of the light supplied from the backlight unit.

A conventional backlight unit that uses a fluorescent lamp as a light source requires a high voltage and consumes high power. Light emitting diode ("LED') based backlights have been used in recent years to reduce power consumption. LEDs are complex semiconductors that convert an electrical current into light. The conversion process is fairly efficient in that it generates little heat compared to incandescent or fluorescent lights. In this case, an LCD panel is divided into a plurality of display areas to improve the contrast ratio of a dark portion of the LCD panel. Such an LCD device includes a plurality of backlight unit drivers for driving the LEDs arranged in light emitting areas to drive a backlight unit having a plurality of light emitting areas.

FIG. 1 is a circuit diagram showing a backlight unit and a backlight unit driver according to the related art.

Referring to FIG. 1, a backlight unit includes at least one LED 5 per light emitting area. When a plurality of LEDs 5 are provided, the LEDs 5 are connected to each other in series. The LED 5 arranged in each light emitting area receives an LED driving voltage VLED from a backlight unit driver 6 to emit light. The backlight unit driver 6 adjusts the level and supplying time of the LED driving voltage VLED by modulating an input voltage VIN and/or a dimming signal DS so that luminance per light emitting area is adjusted.

To adjust the luminance of the LEDs formed in respective light emitting areas, a plurality of backlight unit drivers 6 should be provided. The number of backlight unit drivers 6 provided is typically equal to the number of the light emitting areas, to control the luminance of the LEDs. Thus manufacturing costs are increased and the size of the backlight unit driver 6 is increased.

SUMMARY OF THE INVENTION

An aspect of the present invention provides a backlight unit that reduces the number of backlight unit drivers required by providing a single backlight driver that drives current through a plurality of the LEDs that light respective light emitting areas of an LCD panel, an LCD including the same, and method of driving the LCD.

Additional features of the invention will be set forth in the detailed description of exemplary embodiments that follows, or may be learned by practice of the disclosure.

An exemplary embodiment of the present invention provides a backlight unit including: a substrate divided into a plurality of light emitting areas. At least one light emitting diode is formed in each of the light emitting areas. A bypass unit (a bypass current path around the light emitting diode) is connected in parallel with the light emitting diode. A connection line (node) connects the light emitting diode and the bypass unit formed in the light emitting area. A switching unit is connected between the light emitting diode and the bypass unit to alternately connect one of the light emitting diode and the bypass unit to the connection line (and the light emitting diode and the bypass unit) of the next light emitting area. The light emitting diode and the bypass unit formed in a next light emitting area.

Another exemplary embodiment of the present invention provides a liquid crystal display device including: a liquid crystal display panel having a plurality of display areas; a backlight unit; and a backlight unit driver that drives the backlight unit. The backlight unit includes a substrate having a plurality of light emitting areas corresponding to the display areas configured to supply light having different luminance to the display areas of the liquid crystal display panel. Each of the light emitting areas includes at least one light emitting diode, and a bypass unit connected in parallel to the light emitting diode between a connection node (line) and a switching unit. The switching unit is configured to select and connect one of the light emitting diode and the bypass unit to the connection line of the next light emitting area. Thus, a current passing through the LED or bypass current path of the first light emitting area also passes through the LED or bypass current path of each next light emitting area.

Another exemplary embodiment of the present invention provides a method of driving a liquid crystal display device that includes a liquid crystal display panel divided into a plurality of display areas, a backlight unit, and a backlight unit driver for driving the backlight unit, wherein the backlight unit includes light emitting diodes formed in light emitting areas corresponding to the display areas, a bypass unit connected to the light emitting diodes in parallel, a switching unit connected between the light emitting diodes and the bypass unit to select the light emitting diodes or the bypass unit, and a connection line that serially connects the light emitting diodes and the bypass unit formed in a light emitting area to the light emitting diodes and the bypass unit formed in a next light emitting area The method includes: supplying a light emitting diode driving voltage to the backlight unit; supplying a dimming signal to the switching unit in each light emitting area to adjust the light emitting time of the light emitting diodes in each light emitting area; and displaying an image in the liquid crystal display panel by light supplied from the light emitting diodes.

The invention is described more fully hereinafter with reference to the accompanying drawings of exemplary embodiments of the invention. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. In the drawings, like reference numerals in the drawings denote like elements.

BRIEF DESCRIPTION OF THE DRAWINGS

The accompanying drawings are included to provide a further understanding of the disclosure and are incorporated in and constitute a part of this specification. The accompanying drawings illustrate exemplary embodiments of the disclosure, and together with the description serve to explain the principles of the disclosure. In the accompanying drawings.

DETAILED DESCRIPTION OF EXEMPLARY EMBODIMENTS OF THE INVENTION

Figure 1:
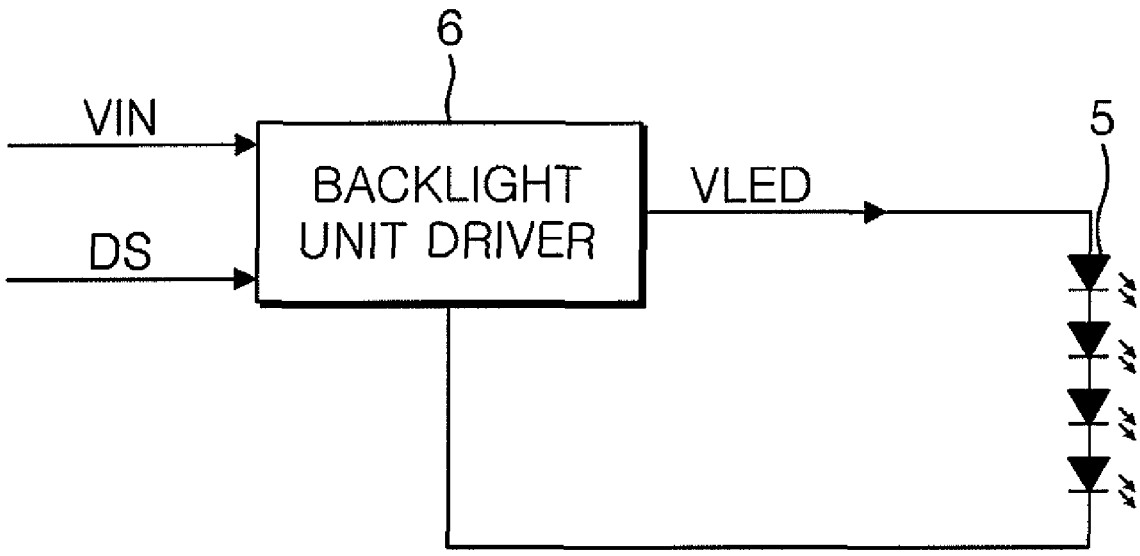
FIG. 1 [RELATED ART]
FIG. 1 is a circuit diagram of a backlight unit and of a backlight unit driver according to a related art.
Figure 2:
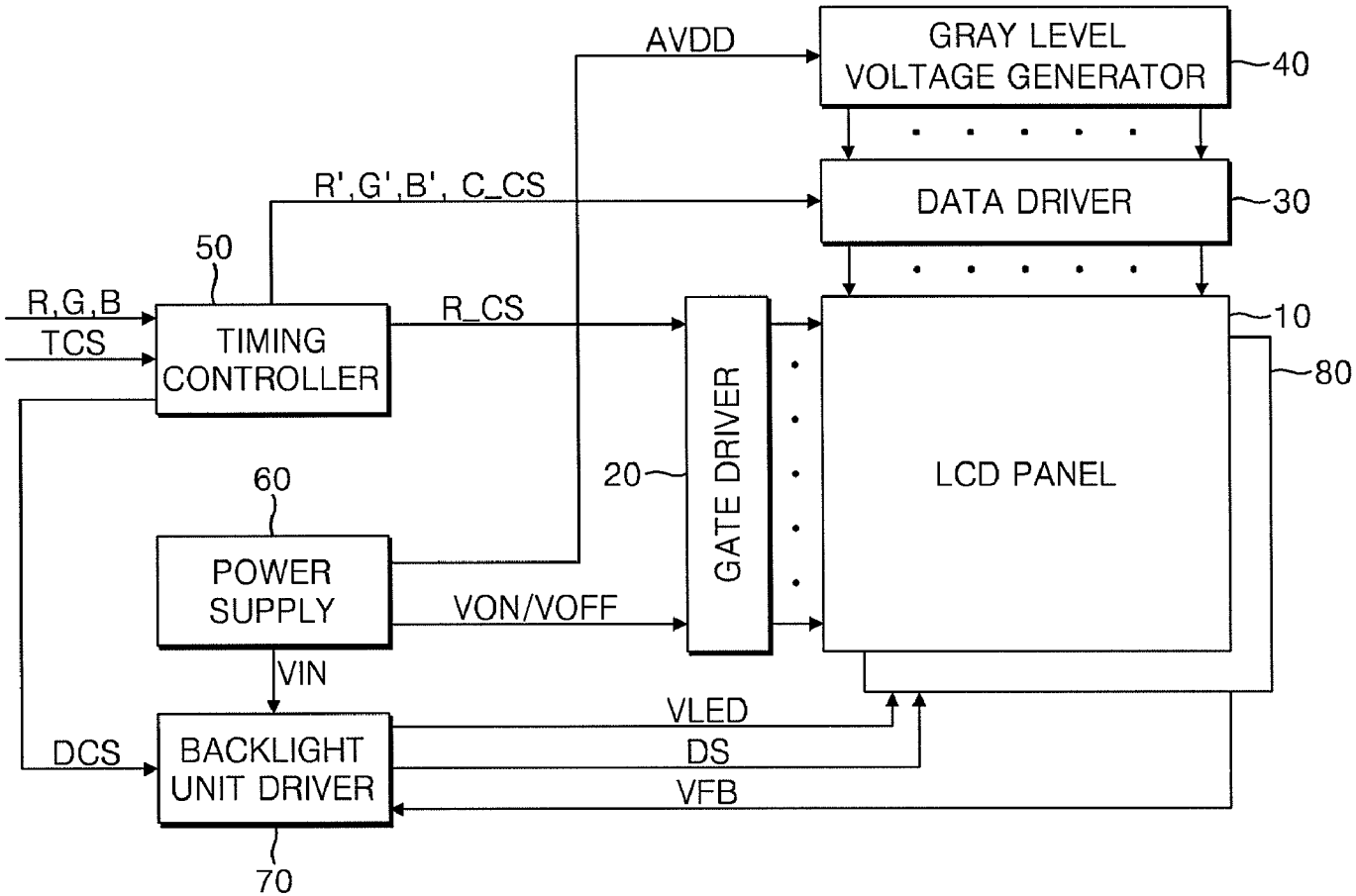
FIG. 2 is a block diagram of an LCD device according to an exemplary embodiment of the present invention.

FIG. 2 is a block diagram showing an LCD device according to an exemplary embodiment of the present invention.

Referring to FIG. 2, an LCD device includes an LCD panel 10, a gate driver 20, a data driver 30, a timing controller 50, a backlight unit 80, and a backlight unit driver 70.

The LCD panel 10 includes a plurality of gate lines (not shown), a plurality of perpendicular data lines (not shown) that cross the gate line, a plurality of thin film transistors (TFTs) arranged at the crossing points of the gate lines and the data lines, and a pixel electrode connected to each of the thin film transistors. The LCD panel 10 displays images by modulating light transmitted through pixels activated in response to applying a gate-on voltage VON supplied through the gate line and an analog pixel (data) voltage supplied through the data line.

Figure 3:
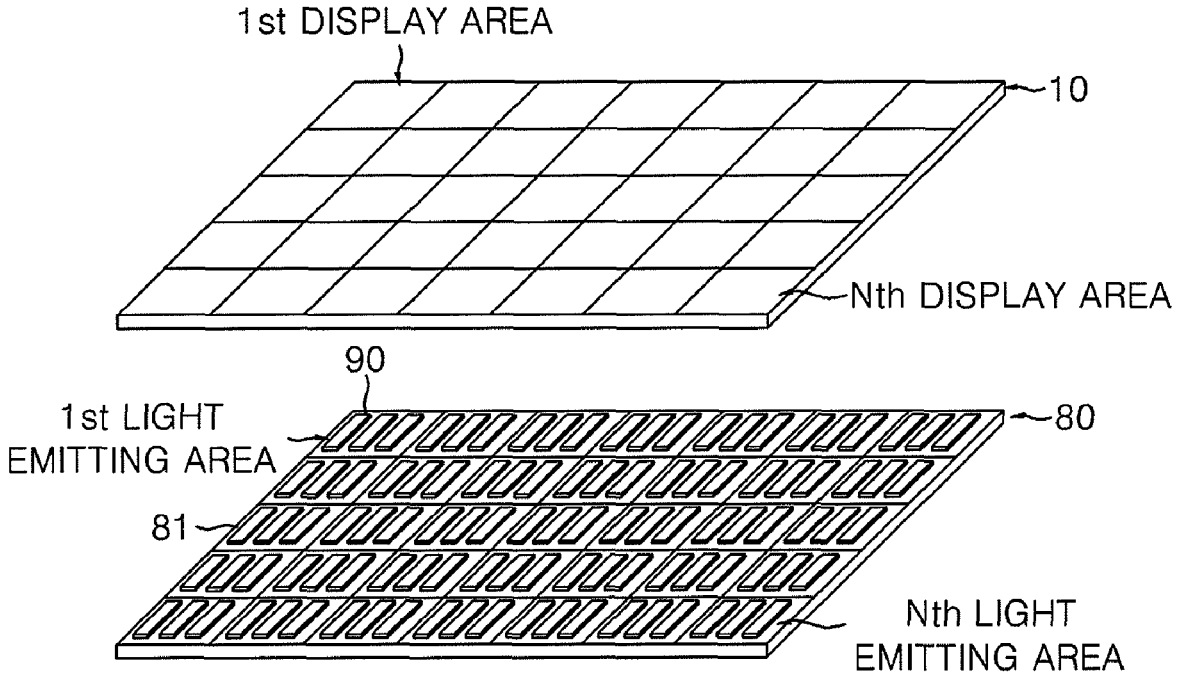
FIG. 3 is a diagram illustrating the plurality of N light emitting areas of the backlight unit 80 and the corresponding N display areas of the LCD panel 10 shown in FIG. 2.

The LCD panel 10 is divided into a plurality N of display areas (as illustrated in FIG. 3). A plurality of pixels is arranged in a matrix in the divided display area. Each display area receives light from at least one light emitter (e.g., LEDs) in a corresponding light emitting area of the backlight unit 80 according to the average value of pixel data to be displayed within the display area.

The gate driver 20 sequentially supplies the gate-on voltage VON and a gate-off voltage VOFF supplied from a power supply 60 to the plurality of gate lines according to a gate control signal R_CS supplied from the timing controller 50.

The data driver 30 outputs analog pixel (data) signals that have been converted into gray level voltages corresponding to pixel data signals R', G', and B' supplied from the timing controller 50 according to a pixel data control signal C_CS supplied from the timing controller 50.

A gray level voltage generator 40 generates a plurality of gray level voltages from an analog driving voltage AVDD supplied from the power supply 60 and supplies the generated gray level voltages to the data driver 30.

The timing controller 50 converts external pixel data signals R, G, and B, and an external input control signal TCS into the pixel data signals R', G' and B', the gate control signal R_CS, the pixel data control signal C_CS, and a dimming control signal DCS. The timing controller 50 supplies the gate control signal R_CS, the pixel data signals R', G' and B', and the dimming control signal DCS to the gate driver 20, the data driver 30, and the backlight unit driver 70, respectively. The timing controller 50 may be a programmable device. The timing controller 50 may include a field programmable gate array ("FPGA") therein in which gate logic arrays are regularly and repetitively arranged. The FPGA calculates average luminance of each display area of the LCD panel 10 by carrying out a mathematical operation upon the external pixel data signals R, G and B for each frame and generates the dimming control signal DCS corresponding to the average luminance.

The power supply 60 generates driving signals, such as the gate-on voltage VON and the gate-off voltage VOFF, the analog driving voltage AVDD, and an input voltage VIN from an externally received power supply voltage (not shown). The gate-on and gate-off voltages VON and VOFF are supplied to the gate driver 20. The analog driving voltage AVDD and the input voltage VIN are supplied to the gray level voltage generator 40 and to the backlight unit driver 70, respectively.

FIG. 3 is a diagram illustrating the plurality of N light emitting areas of the backlight unit 80 and the corresponding N display areas of the LCD panel 10 shown in FIG. 2.

Figure 4:
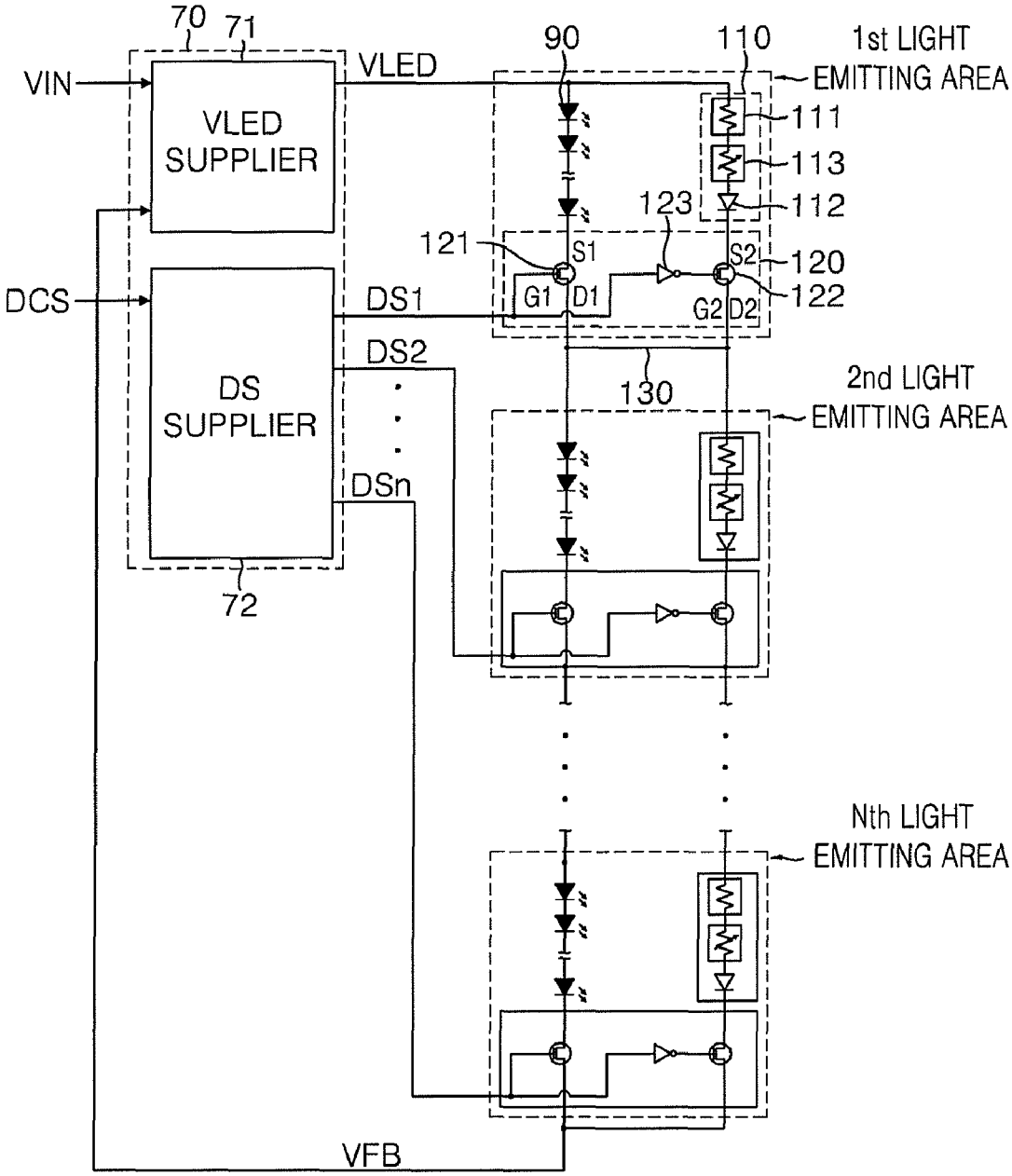
FIG. 4 is a circuit diagram of the backlight unit driver 80 and of the N light emitting areas of the backlight unit 80 shown in FIG. 2.

FIG. 4 is a circuit diagram of the N light emitting areas of the of the backlight unit 80 and a block diagram of the backlight unit driver 70 shown in FIG. 2.

Referring to FIG. 4, the backlight unit driver 70 includes an LED driving voltage supplier 71 and a dimming signal supplier 72.

The LED driving voltage supplier 71 generates an LED driving voltage VLED using the input voltage VIN. The LED driving voltage VLED may drive all LEDs 90 included in the backlight unit 80. The LED driving voltage supplier 71 supplies a driving voltage higher than the total voltage obtained by multiplying the forward voltage drop of the LED 90 by the number of LEDs 90. For example, when the forward voltage drop of each LED 90 is about 0.5V to about 1V and the number of the LEDs 90 is 50, the driving voltage of about 30V to about 60V may be applied to the LEDs 90. The LED driving voltage VLED is correspondingly increased as the number of the LEDs 90 is increased.

The dimming signal supplier 72 supplies a plurality (N) of dimming signals DS1 to DSn, that adjust the driving times of the light emitters (e.g., LEDs 90) included within the light emitting areas, to a corresponding plurality (N) of switching units 120 of the respective N light emitting areas. The dimming signal supplier 72 controls the driving times of the LEDs 90 included within each of the first to Nth light emitting areas using the dimming control signal DCS supplied from the timing controller 50 for one frame. For example, when an amount of light to be emitted in the first light emitting area during one frame is 40% (based on full white being 100%), the dimming signal DS1 is supplied at a high level to the first light emitting area for 0.4 H, and the dimming signal DS1 of a low level is supplied to the first light emitting area for the remainder time period of the frame. The 'H' means the time interval of one frame. At the same time, the dimming signal supplier 72 supplies the dimming signals DS2 to DSn at a high or low level to the other light emitting areas to control the light emitting time of LEDs formed in the other light emitting areas.

Referring to FIG. 3 and FIG. 4, the backlight unit 80 includes an LED substrate 81 having a plurality of light emitting areas. The LED substrate 81 is divided into the plurality (N) of light emitting areas corresponding to the N display areas of the LCD panel 10. Within each of the light emitting areas, upon the LED substrate 81 is formed: at least one light emitter (LEDs 90), a bypass current path (bypass unit) 110, a switching unit 120, and a connection node (line) 130. The LED substrate 81 may be a printed circuit board or a flexible printed circuit board, glass or other substrate.

The LEDs 90, the bypass unit 110, and the switching unit 120 are formed within each light emitting area on the LED substrate 81. In each light emitting area LEDs 90 are connected in parallel with a bypass unit 110 at a connection node (line) 130 and through a switching unit 120. The LEDs 90 and the (parallel) bypass unit 110 in one light emitting area are connected in series to the LEDs and the (parallel) bypass unit 110 in the next light emitting area through the switching unit 120 and the connection node (line) 130.

At least one LED 90 is provided in each light emitting area of the LED substrate 81. The LED 90 may be a white LED that generates white light. Alternatively, the LED 90 may be an LED that generates white light by using a fluorescent material in an LED having a single wavelength. In alternative embodiments (see FIG. 8) the LED 90 may be an LED that generates a single wavelength of light, obviating a color filter layer. To improve the luminance of light supplied to the LCD panel 10, a plurality of LEDs 90 are serially connected to each other to increase the light output in each light emitting area.

The bypass unit 110 includes a resistor 111 and a diode 112 that are connected to each other in series formed on the LED substrate 81. The bypass unit 110 is connected in parallel to the LEDs 90 of each light emitting area. The bypass unit 110 conducts the LED driving voltage VLED after the light emitting time of the LEDs 90, to the LEDs 90 or bypass unit 110 of the next light emitting area.

The resistor 111 has a resistance value that drops the voltage within the same range of a forward voltage drop generated from the LEDs 90.

The diode 112 is forwardly connected to the bypass unit 110 to limit the current applied to the backlight unit driver 70.

The bypass unit 110 may further include a thermistor 113. The thermistor 113 has a negative temperature coefficient having a resistance value inversely proportional to the LCD panel's temperature. Since the resistor 111 and the thermistor 113 are connected to each other in series, the total resistance value of the bypass unit 110 is the same as that of the LEDs 90. In alternative embodiments, the resistor 111 and the may be replaced with diodes that are not light emitting diodes.

The switching unit 120 includes an N-type switch (first switching element 121) and a P-type switch (the second switching element 122 and inverter 123). The first switching element 121 is connected between the LEDs 90 of each light emitting area and the connection line 130 of the next light emitting area. The second switching element 122 is connected between the bypass unit 110 of each light emitting area and the connection line 130 of the next light emitting area. The dimming signal DS from the dimming signal supplier 72 is supplied to the switching unit 120 to control the turn-on of the first switching element 121 and through the inverter to simultaneously the turn-off of the second switching element 122. The inverted dimming signal DS having is supplied to the second switching element 122. For example, when the dimming signal DS is supplied at a high level to the first switching element 121, the inverted dimming signal DS is supplied at a low level to the second switching element 122. Accordingly, when one of the first switching element 121 and the second switching element 122 is turned ON, the other one is turned OFF.

To alternately turn ON the first switching element 121 and the second switching element and 122, one of the first switching element 121 may be formed of an N type field effect transistor (NFET) and the second switching element 122 may be formed of a P type field effect transistor (PFET) and the inverter 123 may be obviated. However, when both the first switching element 121 and the second switching element 122 are formed of either an N type field effect transistor (NFET, e.g., NMOS) or a P type field effect transistor (PFET, e.g., PMOS) as shown in FIG. 4, an inverter 123 may be connected to a gate electrode G1 or G2 of the first switching element 121 or the second switching element 122.

In the exemplary embodiment illustrated in FIG. 4, since the first switching element 121 and the second switching element 122 are both formed of an N type switching element, the inverter 123 is connected to the gate electrode G2 of the second switching element 122. However, the inverter 123 may alternatively be connected to the gate electrode G1 of the first switching element 121. The gate electrode G1 of the first switching element 121 is connected to the DS1 signal output by the dimming signal supplier 72. The source electrode S1 of the first switching element 121 is connected to the LED 90 and a drain electrode D1 thereof is connected to the connection line 130 of the next light emitting area. The gate electrode G2 of the second switching element 122 is connected directly to the dimming signal supplier 72 or indirectly through the output terminal of the inverter 123. A source electrode S2 of the second switching element 122 is connected to an output terminal of the diode 112 of the bypass unit 110 and a drain electrode D2 thereof is connected to the connection line 130 of the next light emitting area.

Each of the first switching element 121 and the second switching element 122 may be a implemented as a transistor, preferably a field effect transistor (FET) such as a metal oxide silicon field effect transistor (MOSFET).

The connection line 30 functions to insure the conduction of current due to the LED driving voltage VLED from one light emitting area to the next light emitting area. For example, because only one of the LEDs 90 or the bypass unit 110 in the first light emitting area will be a conducting path for current, the LED driving voltage VLED may be passed to the second light emitting area via the connection line 130.

Since the LEDs 90 in all light emitting areas of the backlight unit 80 are serially connected to each other, the LED driving voltage VLED may be conducted through all the LEDs 90. The LED driving voltage VLED is supplied to the LEDs 90 or the bypass unit 100 in the first light emitting area and then to the LEDS 90 or the bypass unit 110 in the next light emitting area (e.g., via the connection line 130). The LED driving voltage VLED dropped through the Nth light emitting area is fed back to the LED driving supplier 71. A feedback voltage VFB output from the Nth light emitting area controls a level of the LED driving voltage VLED. When the feedback voltage VFB is a low level, the feedback voltage VFB controls and increases the LED driving voltage VLED. When the feedback voltage VFB is a high level, the feedback voltage VFB controls and decreases the LED driving voltage VLED.

When the bypass unit 110 does not include the resistor 111, the feedback voltage VFB fed back to the backlight unit driver 70 is increased by the voltage drop by the LEDs 90. When the feedback voltage VFB increases, the luminance may be decreased because the amount of current supplied from the backlight unit driver 70 to the LEDs 90 is decreased. The thermistor 113 prevents the feedback voltage VFB from being increased due to the temperature of the LED 90. When the LEDs 90 are driven for a long time, the amount of the voltage drop through each of the LEDs 90 is decreased since an internal resistance is lowered by heat. Accordingly, the resistance value of the bypass unit 110 should be automatically lowered to obtain a lower voltage drop.

Figure 5:
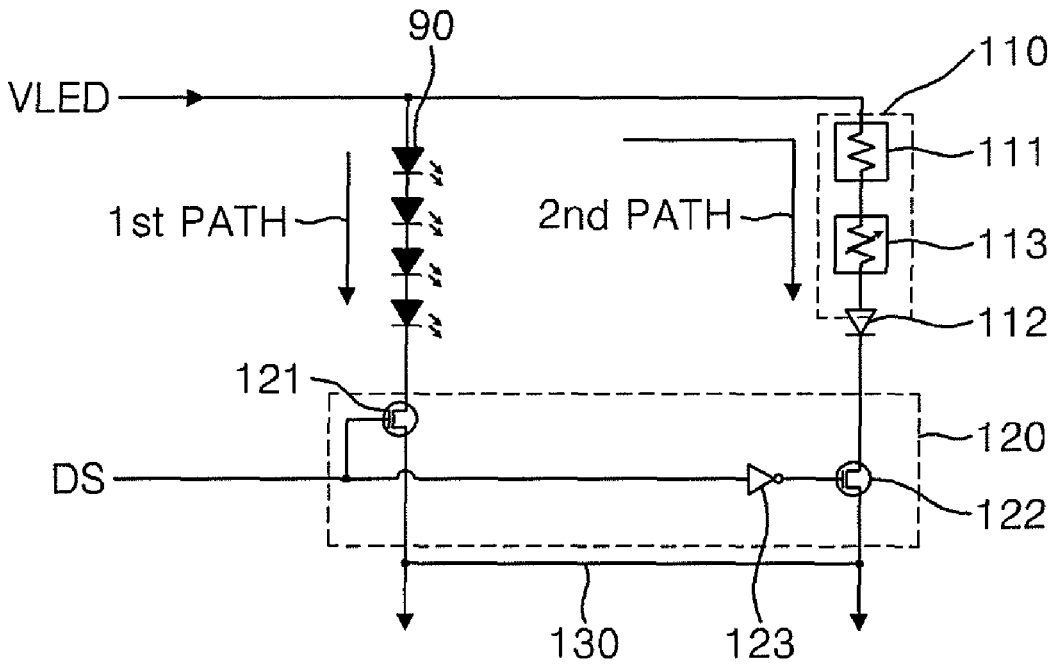
FIG. 5 is a circuit diagram of the first light emitting area among the N light emitting areas shown in FIG. 3 and FIG. 4.

FIG. 5 is a circuit diagram of the first light emitting area shown in FIG. 3 and FIG. 4.

Referring to FIG. 5, when the first dimming signal DS (DS1) is output at a high level from the dimming signal supplier 72 (see FIG. 4), the first switching element 121 is turned ON and the second switching element 122 is turned OFF. Accordingly, the LED driving voltage VLED turns ON the LEDs 90 along a first current path to generate light and is subject to the forward voltage drop of the ON LEDs 90. The dropped LED driving voltage VLED is supplied to the second light emitting area.

When the first dimming signal DS1 is output at a low level from the dimming signal supplier 72, the first switching element 121 is turned OFF and the second switching element 122 is turned ON. Accordingly, the LED driving voltage VLED is supplied to the second light emitting area through the bypass unit 110 along a second current path.

Local dimming control that controls the luminance of each light emitting area is implemented by modulating supplying time of (pulse-width modulation of) the dimming signal DS at a high level. When setting the high level interval of the dimming signal DS by calculating the mean value of the luminance to be displayed at each light emitting area, the luminance displayed at each light emitting area is proportional to the turn-on time of the LED 90. Accordingly, when the luminance of 100% is to be displayed at any light emitting area for one frame, all LEDs 90 arranged in that light emitting area are turned ON for one full frame time interval.

When the luminance of 0% is to be displayed at any light emitting area, the LEDs 90 arranged in that light emitting area are turned OFF for one full frame time interval. When the luminance of 0% is displayed at any one light emitting area for one frame, since the LEDs 90 are not required to output light, power consumption is decreased, and the contrast ratio of the LCD panel 10 is improved by preventing light leakage.

Figure 6:
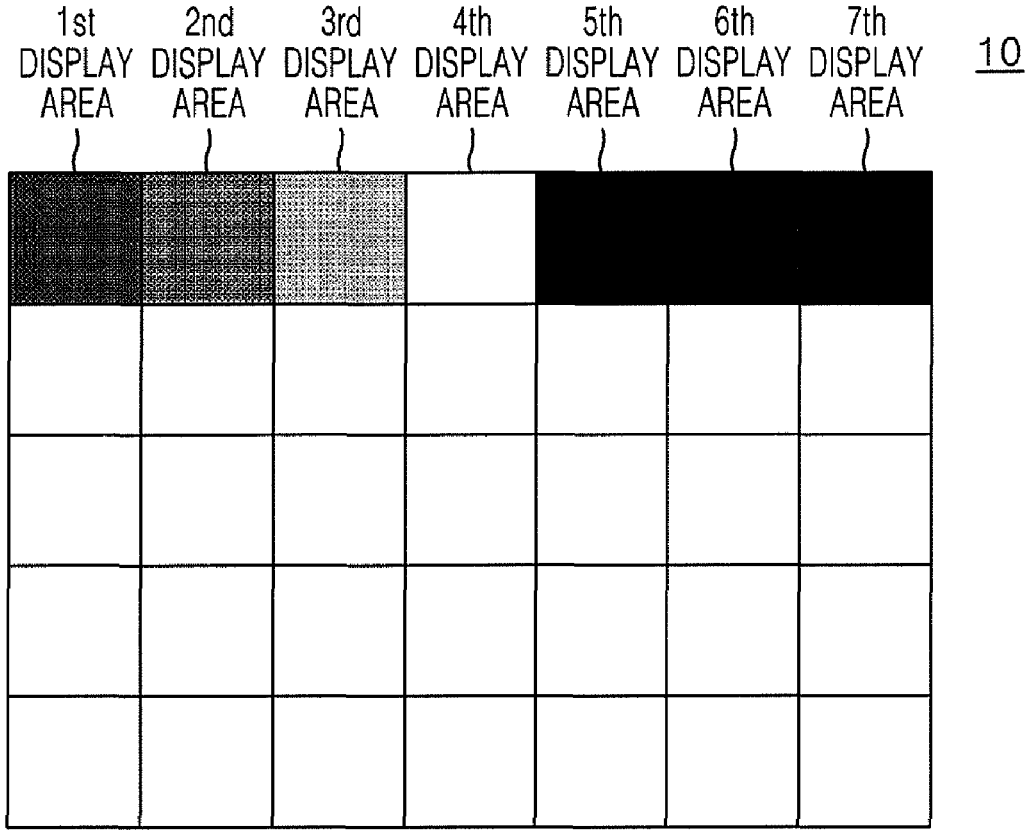
FIG. 6 is a plan view illustrating an exemplary variation of the mean luminance among a plurality of display areas of an LCD panel according to an exemplary embodiment of the present invention.

FIG. 6 is a plan view illustrating an exemplary variation of the mean luminance among a plurality of display areas of an LCD panel according to an exemplary embodiment of the present invention.

Figure 7:
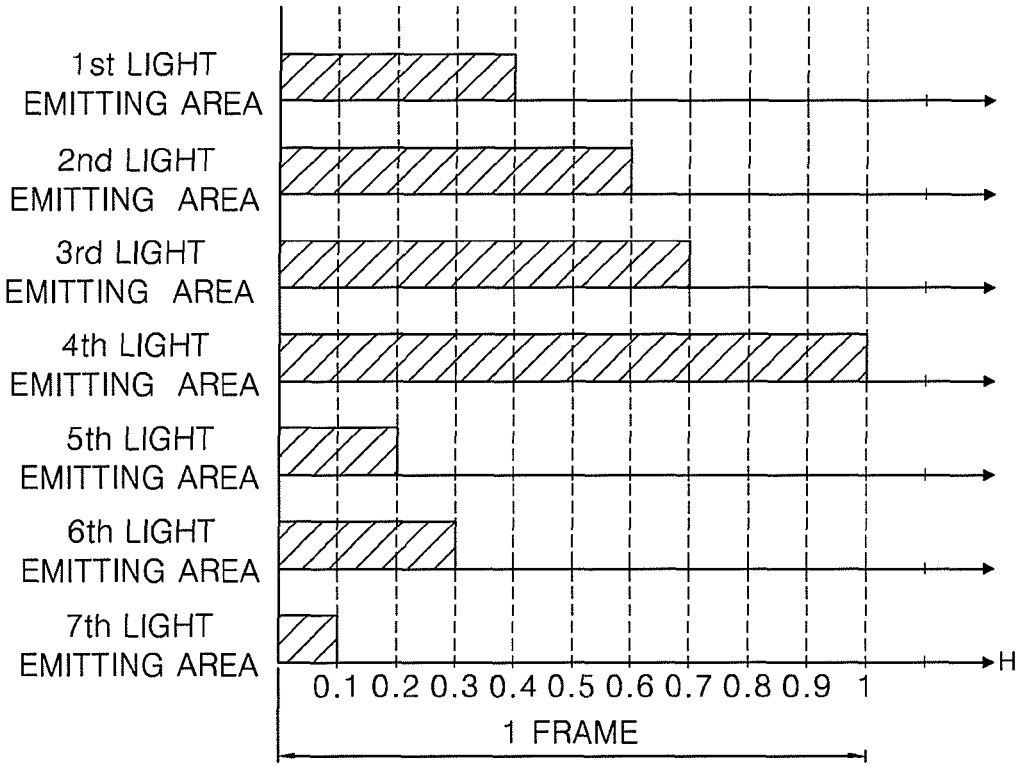
FIG. 7 is a timing diagram of driving the backlight unit for supplying variations of light luminance to the display areas shown in FIG. 6.

FIG. 7 is a driving timing diagram of the backlight unit for supplying variations of light luminance to the display areas shown in FIG. 6.

Referring to FIG. 6 and FIG. 7, the luminance per display area of the LCD panel 10 is varied. For convenience of description, the mean luminance of each of first to seventh display areas will be explained. In the first to seventh display areas, a black color is displayed on the basis of the luminance of 0% and a white color is displayed on the basis of the luminance of 100%. The luminance of the first to seventh display areas of the LCD panel 10 within one frame time interval is determined in the range of 0% to 100% and the light emitting time of the LEDs 90 is determined to obtain each luminance.

The LEDs arranged in the first light emitting area emit light for 0.4 H. The LEDs arranged in the second, third, fourth, fifth, sixth, and seventh areas emit light for 0.6 H, 0.7 H, 1 H, 0.2 H, 0.3 H, and 0.1 H, respectively. The 'H' means the time interval of one frame. When the LCD device is driven at 60 Hz, H is 16.67 ms.

Referring to FIG. 2, FIG. 4, and FIG. 7, the LED driving voltage VLED from the backlight unit driver 70 is supplied to the first light emitting area and first through seventh dimming signals DS1 to DS7 from the dimming signal supplier 72 are respectively supplied to the respective switching units 120 arranged in the first to the seventh light emitting areas. The dimming signal supplier 72 supplies different dimming signals to the switching units 120 arranged in the first to the seventh light emitting areas.

The LED driving voltage VLED supplied to the first light emitting area drives the LEDs 90 arranged in the first light emitting area according to the first dimming signal DS1. The first dimming signal DS1 is supplied at a high level to the switching unit 120 of the first light emitting area for 0.4 H. The first switching element 121 of the first light emitting area is turned ON for 0.4 H and supplies the LED driving voltage VLED to the LEDs 90 arranged in the first light emitting area to generate light. At this time, since the inverted dimming signal by the inverter 123 is supplied to the second switching element 122 of the first light emitting area, the second switching element 122 of the first light emitting area is turned OFF for 0.4 H. While the LEDs 90 arranged in the first light emitting area are driven ON, the LED driving voltage VLED is dropped and the dropped LED voltage is supplied to the second light emitting area.

After 0.4 H, the dimming signal DS1 is supplied at a low level to the switching unit 120 of the first light emitting area. Accordingly, the first switching element 121 arranged in the first light emitting area is turned OFF to turn OFF the LEDs 90 arranged in the first light emitting area. In addition, the second switching element 122 of the first light emitting area is turned ON to supply the LED driving voltage VLED to the second light emitting area through the bypass unit 110 of the first light emitting area. The LED driving voltage VLED is dropped through the resistor 111 and the thermistor 113 of the bypass unit 110 of the first light emitting area to a level approximately equal to the voltage drop generated in the LEDs 90 of the first light emitting area, and then supplied to the second light emitting area.

In the second light emitting area, the LEDs 90 are driven by the dropped LED driving voltage to generate light. The second dimming signal DS2 of a high level is supplied to the second light emitting area for 0.6 H and the second dimming signal DS2 is supplied at a low level to the second light emitting area for the remainder of the frame time interval (0.4 H). Accordingly, the LED 90 arranged in the second light emitting area generates light for 0.6 H and does not emit light for the remainder of the frame time interval (0.4 H) since the LEDs 90 are turned OFF by bypassing the LED driving voltage VLED through the bypass unit 110 arranged in the second light emitting area. The LED driving voltage VLED is dropped while the LEDs 90 arranged in the second light emitting area are driven ON or OFF and then the dropped LED driving voltage is supplied to the third light emitting area.

The method for driving the third to the seventh light emitting areas are the same as those of the first and second light emitting areas. Accordingly, repeated descriptions will be omitted.

Figure 8:
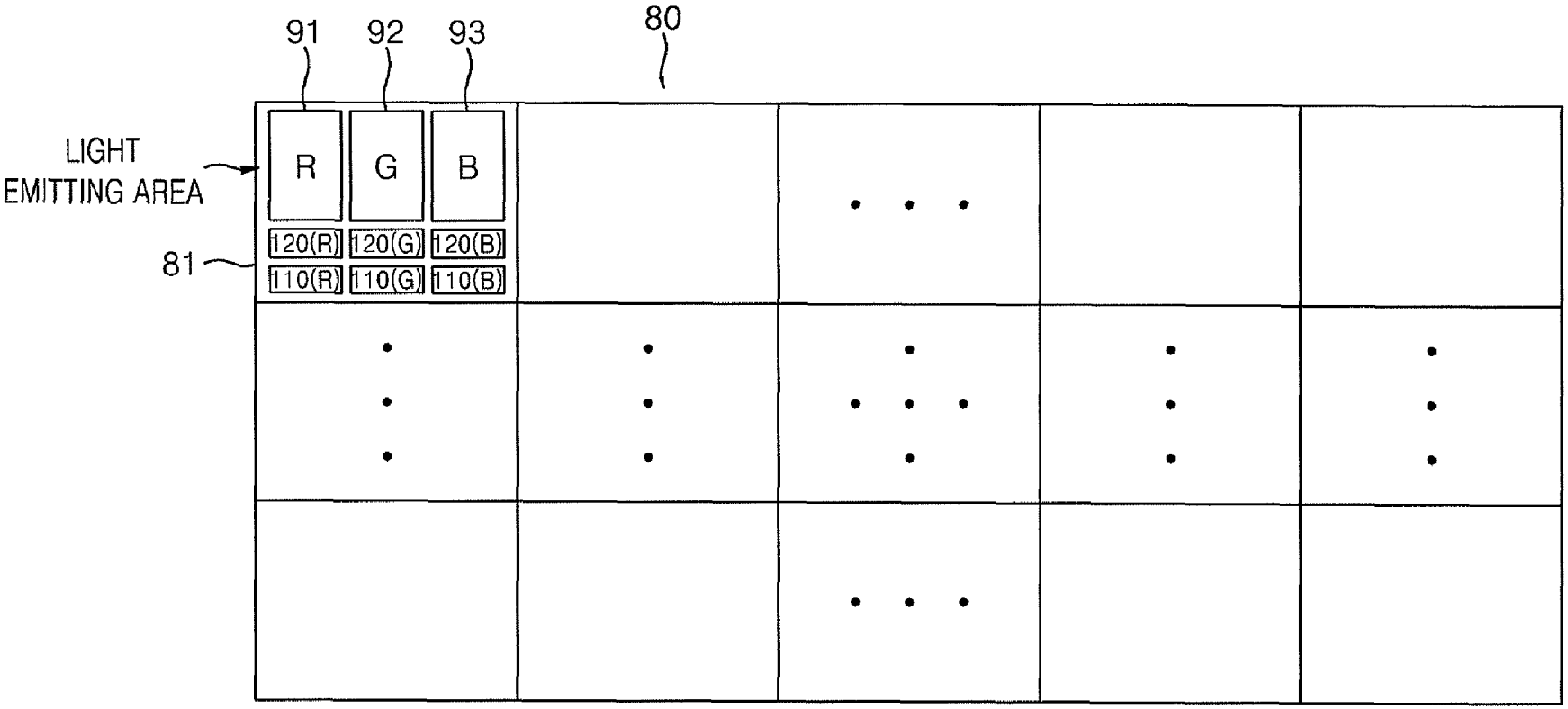
FIG. 8 is a plan view of an LCD device including a backlight unit according to another exemplary embodiment of the present invention.

FIG. 8 is a plan view of an LCD device including a backlight unit according to another exemplary embodiment of the present invention.

Figure 9:
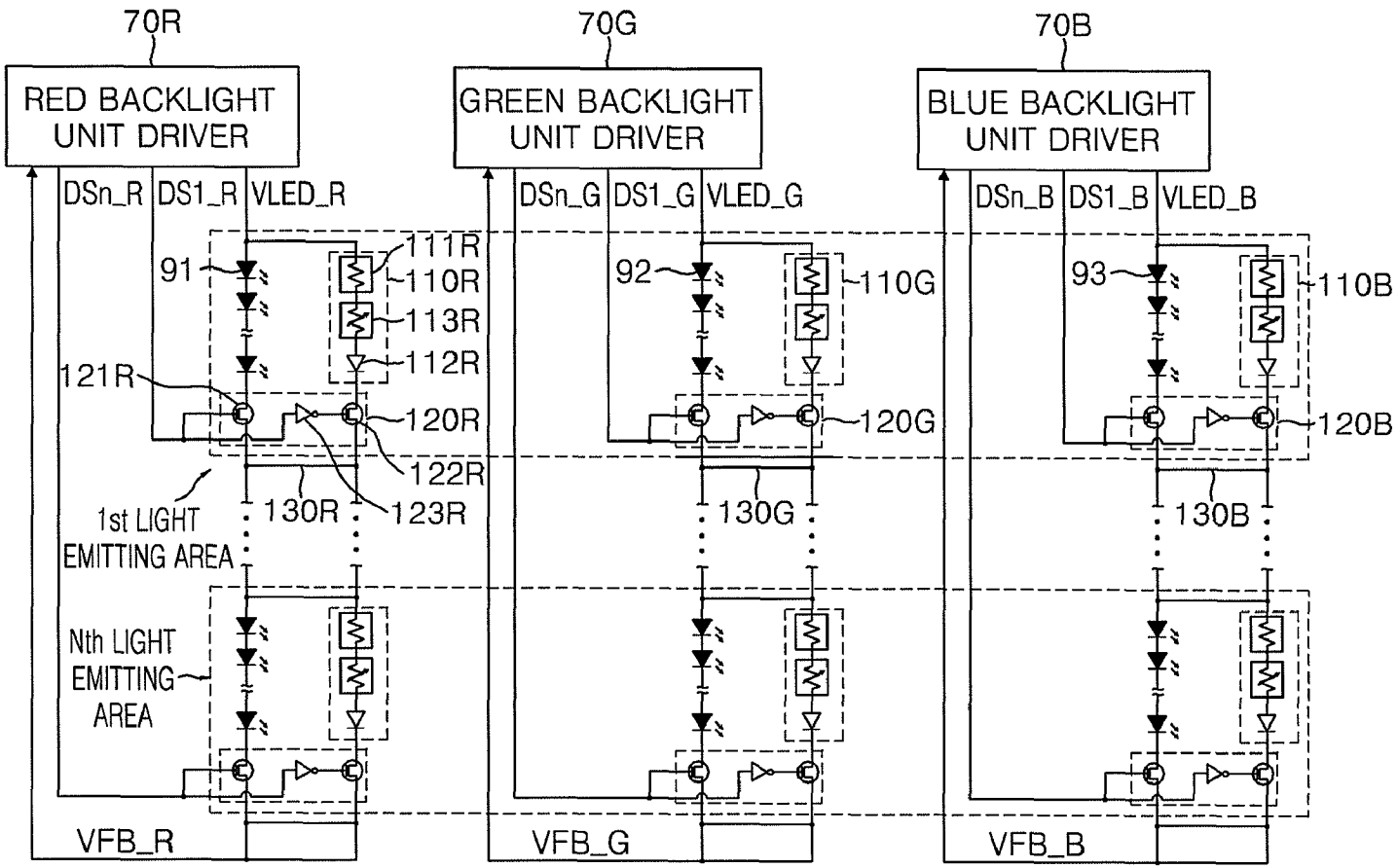
FIG. 9 is a circuit diagram of the backlight unit and R, G and B backlight unit drivers of the LCD device of FIG. 8.

FIG. 9 is a circuit diagram of the backlight unit and R, G and B backlight unit drivers of the LCD device of FIG. 8.

Referring to FIG. 8 and FIG. 9, an LCD device includes a backlight unit 80 and red backlight unit driver 70R, green backlight unit driver 70G, and blue backlight unit drivers 70B. The backlight unit 80 includes red LEDs 91, green LEDs 92, and blue LEDs 93, red bypass units 110R, green bypass units 110G, and blue bypass units 110B, and red switching units 120R, green switching units 120G, and blue switching units 120B, that are formed in the light emitting areas. The backlight unit drivers 70R, 70G, and 70B drive the backlight unit 80.

The red backlight unit driver 70R drives the red LEDs 91. The green backlight unit 70G drives the green LEDs 92. And, the blue backlight unit driver 70B drives the blue LEDs 93. Each of the backlight unit drivers 70R, 70G, and 70B includes one of LED driving voltage supplier 71 and one dimming signal supplier 72 as shown in the backlight unit driver 70 in FIG. 4.

The red backlight unit driver 70R generates a red LED driving voltage VLED_R for driving the red LEDs 91 and generates dimming signals DS1_R to DSn_R. The green backlight unit driver 70G generates a green LED driving voltage VLED_G for driving the green LEDs 92 and generates dimming signals DS1_G to DSn_G. The blue backlight unit driver 70G supplies a blue LED driving voltage VLED_B for driving the blue LEDs 93 and generates dimming signals DS1_B to DSn_B.

At least one red LED 91 is arranged in each light emitting area to generate red light. When a plurality of red LEDs 91 are formed in one light emitting area, the red LEDs 91 may be connected to each other in series.

The bypass unit 110R is connected in parallel to the red LEDs 91. The bypass unit 110R includes a resistor 111R and a diode 112R. The bypass unit 110R may further include a thermistor 113R. The resistor 111R has a resistance value the same as the internal resistance value of the red LEDs 91, i.e., the same forward voltage drop of the red LEDs 91.

The diode 112R prevents the red LED driving voltage VLED_R from driving backward through the red LEDs 91. The diode 112R is connected in a forward direction to the bypass unit 110R.

The thermistor 113R lowers the internal resistance value when the resistance value of the red LEDs 91 is lowered due to heat generated while the red LEDs 91 emit light. When the bypass unit 100R uses only the resistor 111R without the thermistor 113R, since the feedback voltage VFB_R is increased, light having luminance lower than calculated luminance may be output. Accordingly, the thermistor 113R having a negative temperature coefficient that has a resistance value inversely proportional to temperature is used. The total resistance value of the bypass unit 110R is the same as that of the ON red LEDs 91.

The switching unit 120R includes a first switching element 121R and a second switching element 122R that are alternately turned ON and OFF. The first switching element 121R is connected between the red LED 91 and a connection line 130R, and the second switching element 122R is connected between the bypass unit 110R and the connection line 130R.

The first switching element 121R supplies the red LED driving voltage VLED_R to the red LEDs 91 and the second switching element 122R supplies the red LED driving voltage VLED_R to the bypass unit 110R. An inverter 123R may be connected to a gate of the first switching element 121R or to the second switching element 122R.

Either one of the first switching element 121R and the second switching element 122R may be formed of an N type transistor (e.g., NMOS) and the other one may be formed of a P type transistor (e.g., PMOS).

The connection line 130R connects the red LEDs 91 and the bypass unit 110R of one light emitting area to the red LEDs 91 and the bypass unit 110R of the next light emitting area and thus supplies the red LED driving voltage VLED_R to the red LEDs 91 and the bypass unit 110R of the next light emitting area regardless of the ON/OFF state of the LEDs 91 of the prior light emitting area.

The red LEDs 91 arranged in the last light emitting area supply a red feedback voltage VFB_R to the red backlight unit driver 70R. The red feedback voltage VFB_R is input to an LED driving voltage supplier included in the red backlight unit driver 70R to adjust a voltage level of the red LED driving voltage VLED_R output from the red backlight unit driver 70R.

The green and blue LEDs 92 and 93, and the green and blue backlight unit drivers 70G and 70B are the same as the red LEDs 91 and the red backlight unit driver 70R. Accordingly, redundant detailed explanations will be omitted.

The red, green, and blue LEDs 91, 92, and 93 are independently operated in one light emitting area and are driven by the red, green, and blue backlight unit drivers 70R, 70G, and 70B, respectively.

The red, green, and blue LEDs 91, 92, and 93 in each light emitting area emit red, green, and blue light, respectively and the red, green, and blue light is mixed to generate white light. The white light is supplied to the LCD panel. In alternative embodiments, red, green, and blue LEDs may be mixed within each series-connected LED string in each light emitting area to generate white light supplied to the LCD panel. In other alternative embodiments, red, green, and blue LEDs 91, 92, and 93 in each light emitting area emit red, green, and blue light, respectively and the red, green, and blue light is kept separate to back-light vertical columns of red, green and blue pixels respectively.

Each of the dimming signal suppliers included in the backlight unit drivers 70R, 70G, and 70B may use one dimming signal supplier (72, see FIG. 4). Each of the backlight unit drivers 70R, 70G, and 70B may include one LED drivers 70R, 70G, or 70B for respective colors but share a common dimming signal supplier (72). The common dimming signal supplier may simultaneously turn ON or turn OFF all the LEDs of the same color in each light emitting area.

As described above, since LEDs formed in each light emitting area are serially connected to each other and one backlight unit driver drives the serially connected LEDs, the number of backlight unit drivers can be reduced.

In addition, since the backlight unit is driven with a plurality of light emitting areas, power consumption is decreased and display characteristics of dark gray levels are improved.

Furthermore, since red, green, and blue LEDs are arranged in light emitting areas formed in a backlight unit, white light can be supplied to an LCD panel.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A backlight unit, comprising:

a substrate divided into a plurality of light emitting areas, each of the light emitting areas including:

a light emitter;

a bypass current path;

a connection node; and a switching unit, wherein the light emitter and the bypass current path are connected in parallel between the connection node and the switching unit, and wherein the switching unit is connected to a connection node of a next light emitting area and is configured to alternately connect one of the light emitter and the bypass current path to the connection node of the next light emitting area, wherein the switching unit includes, a first transistor connecting the light emitter to the connection node of the next light emitting area, and a second transistor connecting the bypass current path to the connection node of the next light emitting area, wherein a line through which a switch-control signal flows is directly connected to gates of the first and second transistors.

2. The backlight unit of claim 1, wherein the light emitter includes at least one light emitting diode.

3. The backlight unit of claim 2, wherein the light emitter includes a plurality of light emitting diodes connected in series.

4. The backlight unit of claim 2, wherein the bypass current path includes a diode.

5. The backlight unit of claim 1, wherein the first transistors and the second transistor are alternately turned ON and turned OFF by the switch-control signal.

6. The backlight unit of claim 5, wherein one of the first transistor and the second transistor is an N type field effect transistor and the other transistor is a P type field effect transistor.

7. The backlight unit of claim 5, further comprising an inverter between the gates of the first and the second transistor.

8. The backlight unit of claim 1, wherein the bypass current path comprises a resistor that has a resistance approximately equal to the ON resistance through the light emitter.

9. The backlight unit of claim 1, wherein the bypass current path further comprises:

a resistor having a resistance corresponding to the ON resistance of the light emitter; and a thermistor connected in series to the resistor and having a resistance value that varies inversely proportional to the temperature of the light emitter.

10. The backlight unit of claim 1, wherein the light emitter generates white light.

11. The backlight unit of claim 1, wherein each of the light emitting areas further includes a second light emitter and third light emitter, wherein the first, second and third light emitters comprise red light emitting diodes, green light emitting diodes, and blue light emitting diodes, respectively, for generating white light.

12. The backlight unit of claim 11, wherein the red light emitting diodes are serially connected to each other, the green light emitting diodes are serially connected to each other, and the blue light emitting diodes are serially connected to each other.

13. A liquid crystal display device, comprising:

a substrate having a plurality of light emitting areas corresponding to display areas of a liquid crystal display panel, wherein each of the light emitting areas includes:

a light emitting diode;

a bypass current path;

a connection node; and a switching unit;

wherein the light emitting diode and the bypass current path are connected in parallel between the connection node and the switching unit, and wherein the switching unit is connected to a connection node of a next light emitting area, and is configured to alternately connect one of the light emitting diode and the bypass current path to the connection node of the next light emitting area, wherein the switching unit includes, a first transistor connecting the light emitting diode to the connection node of the next light emitting area, and a second transistor connecting the bypass current path to the connection node of the next light emitting area, wherein a line through which a switch-control signal flows is directly connected to gates of the first and second transistors.

14. The liquid crystal display device of claim 13, further comprising a backlight unit driver, wherein each backlight unit driver comprises:

a driving voltage supplier configured to supply a driving voltage across the plurality of light emitting areas; and a dimming signal generator configured to output a plurality of dimming signals to control the switching unit in each of the plurality of light emitting areas supplied by the backlight unit driver, for generating light having different luminance in each light emitting area.

15. The liquid crystal display device of claim 13, one of the first transistor and the second transistor is configured to turn ON and the other transistor is configured to turn OFF.

16. The liquid crystal display device of claim 13, further comprising an inverter connected between the gates of the first transistor and the second transistor.

17. The liquid crystal display device of claim 13, wherein the first light emitting diode generates light of a first color, wherein each light emitting area further comprises:

a second light emitting diode that generates light of a second color, connected in series to a second switching unit; and a third light emitting diode that generates light of a third color, connected in series to a third switching unit, wherein the light generated by the first, second, and third light emitting diodes combines to generate white light.

18. The liquid crystal display device of claim 17, further comprising a second backlight unit driver and a third backlight unit driver, wherein the first, second and third backlight unit drivers drive the first, second, and third light emitting diodes, respectively, and wherein the first, second, and third light emitting diodes are red, green and blue light emitting diodes respectively.

19. A method of driving a liquid crystal display device that comprises a backlight unit, and a backlight unit driver for driving the backlight unit, wherein the backlight unit includes a plurality of light emitting areas, each light emitting area including a light emitter and a bypass current path connected in parallel between a connection node and a switching unit, the switching unit configured to conduct current through a selected one of the light emitter and the bypass current path, the method comprising:

supplying a driving voltage to the connection node of the first light emitting area; and supplying a dimming signal to the switching unit to modulate the light emitting time of the light emitter by alternately conducting current through the selected one of the light emitter and the bypass current path, wherein the switching unit includes, a first transistor connecting the light emitter to a connection mode of a next light emitting area, and a second transistor connecting the bypass current path to the connection node of the next light emitting area, wherein a line through which a switch-control signal flows is directly connected to gates of the first and second transistors.

20. The method of the claim 19, further comprising supplying a second dimming signal to the switching unit of a second light emitting area to modulate the light emitting time of the light emitter of the second switching unit by alternately conducting the current through the light emitter and the bypass current path of the second light emitting area.

21. The method of the claim 19, further comprising:

feeding back a feedback voltage from one of the light emitting areas among the plurality of light emitting areas to the backlight unit driver; and varying a voltage level of the driving voltage based upon the feedback voltage.

* * * * *